US005443532A

United States Patent [19]

Hudak

[11] Patent Number: 5,443,532

[45] Date of Patent: Aug. 22, 1995

[54] APPARATUS FOR ENHANCING SEXUAL INTIMACY

[76] Inventor: Thomas P. Hudak, 31790 US 19 N., Unit 196, Palm Harbor, Fla. 34684

[21] Appl. No.: 177,216

[22] Filed: Jan. 4, 1994

[51] Int. Cl.[6] ..... A47C 20/00

[52] U.S. Cl. ..... 5/652; 5/657; 5/900.5; 5/929; 5/620; 5/662; 5/624

[58] Field of Search ..... 5/620, 624, 630, 632, 5/648, 652, 657, 662, 929, 610, 900.5; 482/140, 142, 145

[56] References Cited

U.S. PATENT DOCUMENTS

| | | | |
|---|---|---|---|
| 810,820 | 1/1906 | Suddarth | 5/620 X |
| 812,240 | 2/1906 | Schoettl et al. | 5/620 X |
| 2,468,856 | 5/1949 | Alexander . | |
| 2,755,152 | 7/1956 | Calgy . | |
| 2,935,210 | 5/1960 | Cohen . | |
| 2,978,713 | 4/1961 | Scalzitti et al. . | |
| 3,286,694 | 11/1966 | Landy . | |
| 3,293,667 | 12/1966 | Ohrberg | 5/610 |
| 3,630,156 | 12/1971 | Woodruff . | |
| 3,668,722 | 6/1972 | Gallant . | |
| 3,696,763 | 10/1972 | Evans . | |
| 3,776,540 | 12/1973 | Comando . | |
| 3,813,091 | 5/1974 | Metzger | 5/929 X |
| 3,855,652 | 12/1974 | Nicholson | 5/929 |
| 4,011,821 | 3/1977 | Neal . | |
| 4,312,088 | 1/1982 | Webb . | |
| 4,333,638 | 6/1982 | Gillotti | 5/620 |
| 4,571,761 | 2/1986 | Perlin . | |
| 4,609,192 | 9/1986 | Bratcher . | |

*Primary Examiner*—Michael F. Trettel
*Attorney, Agent, or Firm*—Hudak & Shunk Co.

[57] ABSTRACT

An apparatus for facilitating sexual intercourse between a female partner lying in an inclined supine position and a male partner in a standing position includes a platform mounted on a frame, such that the platform is inclined at an angle and situated at an elevation which places the vaginal passage of the female in alignment with the distended genitalia of a male partner standing adjacent to the lower end of the platform. The apparatus includes stirrups and handles which allow the female excellent freedom of movement to permit repositioning of her body as desired.

13 Claims, 3 Drawing Sheets

APPARATUS FOR ENHANCING SEXUAL INTIMACY

FIELD OF THE INVENTION

The invention pertains to an apparatus for facilitating more comfortable sexual intercourse between a woman reclined in a supine position and a man in a standing position.

BACKGROUND OF THE INVENTION

Many overweight men and men who have sustained certain types of neurological damage or other physiological impairments sometimes find it difficult or extremely uncomfortable to engage in sexual intercourse while in a prone position, but are able to successfully participate in fulfilling sexual intercourse while standing.

In order for a couple to participate in sexual intercourse while the male partner is in a standing position, the female partner must be supported with her body in an inclined or partially inclined position at an appropriate elevation. One possibility is for the male partner to provide the necessary support. However, it can be extremely strenuous and fatiguing, particularly for certain physiologically impaired men, to support a female partner for the entire duration of the sexual encounter. Various conventional furnishings such as desks, tables, and the like are generally undesirable because they cannot support the female at the appropriate elevation to permit coitus with the male partner standing in a comfortable fully erect position. Moreover, if the couple finds an item of furniture which can support the female at an appropriate elevation to permit sexual intercourse with the male partner standing comfortably in a fully erect position, the female partner generally is not supported in a comfortable reclined position, but instead must be arched forward with her back and legs unsupported in order to properly align the vaginal passage for maximum penetration. In addition to being uncomfortable, such awkward positioning can interfere with the female partner's ability to reposition herself as desired in order to more fully enjoy the experience.

SUMMARY OF THE INVENTION

It is an object of the present invention to provide an apparatus for supporting a female partner in a comfortable supine position at an appropriate angle and elevation for sexual intercourse with a male partner standing in a comfortable, fully erect position.

Another object of the invention is to provide an apparatus for facilitating sexual intimacy between a supine female partner and a standing male partner which includes means for supporting the legs of the female partner to increase her comfort and reduce muscle fatigue.

A further object of the invention is to provide an apparatus which facilitates sexual intercourse with the male partner in a standing position and means which enable the female partner to easily reposition herself while being supported in a supine position in order to maximize gratification during sexual intercourse.

These and other objects and advantages are achieved by provision of an apparatus including a frame for supporting an inclined platform onto which a female partner can be comfortably supported in a supine position with her head at the elevated end of the platform and with her vagina generally overlapping the lowered end of the platform. The lowered end of the platform is at an elevation such that the female partner's genitalia are positioned at a height equal to the vertical distance from the floor to the male partner's genitalia when he is in a comfortable standing position, thereby facilitating coitus.

In accordance with the preferred mode of the invention, the platform is inclined at an angle which is approximately equal to the natural angle of the human vaginal passage. That is to say, the platform is preferably angled so that the vaginal passage is approximately in alignment with the distended penis of a male partner standing upright adjacent to the lowered end of the platform to permit maximum penetration with minimal discomfort.

In accordance with another preferred aspect of the invention, means are provided whereby the female partner can support her lower limbs to reduce muscle fatigue. The lower limb support means are most preferably in the form of multiple loop stirrups which in addition to providing support for the lower limbs also provide resistance means upon which the female can apply force through the lower limbs to move or reposition herself as desired.

Laterally positioned handles are also preferably provided to allow the female to more easily reposition herself as desired. Most preferably, the lower limb support means are utilized in combination with the laterally positioned handles to facilitate maximum freedom of movement for the female while being comfortably supported in an inclined supine position, thereby maximizing the female partner's ability to actively participate in sexual intercourse with a standing male partner.

DETAILED DESCRIPTION OF THE PREFERRED EMBODIMENT

The apparatus generally designated as 10, comprises a frame which supports an inclined platform assembly 14.

In accordance with the preferred embodiment, the apparatus can be easily assembled and disassembled to allow for space savings during storage and to allow for portability. The frame and platform are preferably fabricated from strong, durable, light-weight, rigid plastics such as polyvinyl chloride (PVC) or polycarbonate resins.

Figure 1:
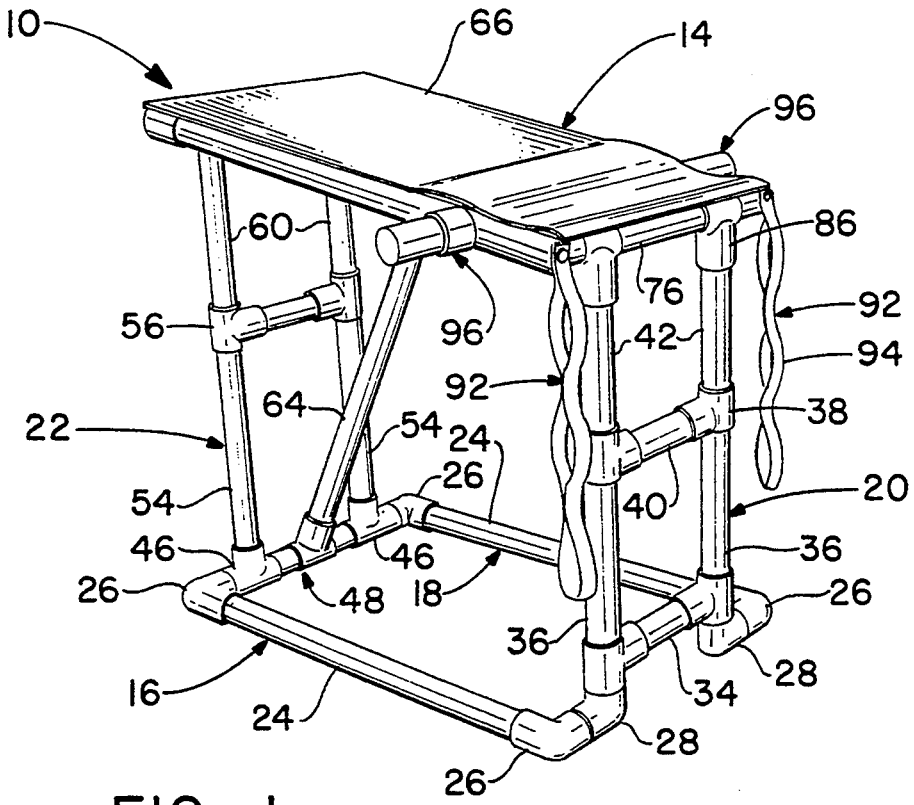
FIG. 1 is a perspective view of the preferred embodiment of the apparatus of the invention.
Figure 2:
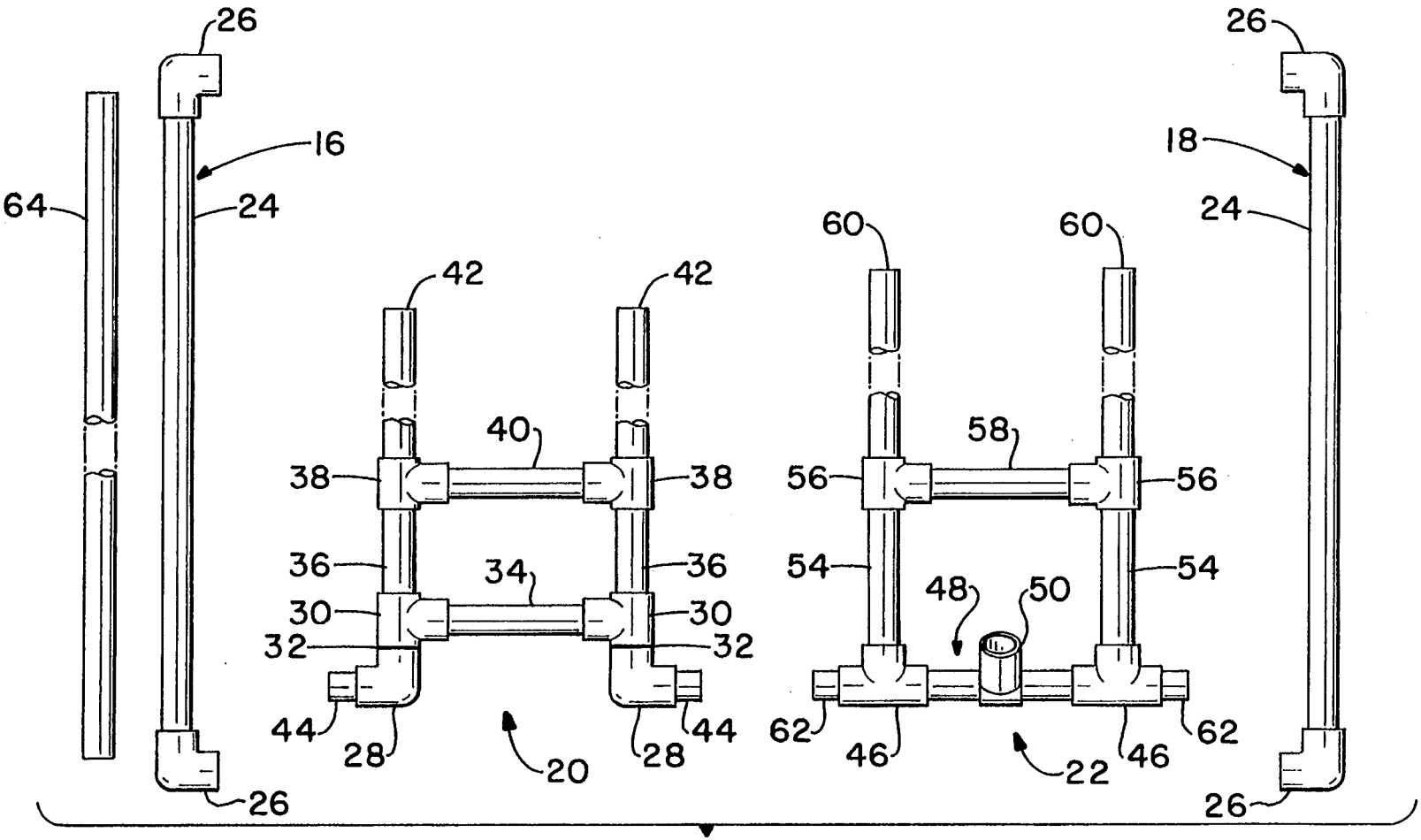
FIG. 2 is a plan view of the unassembled elements forming the frame portion of the apparatus shown in FIG. 1.

The frame as shown in FIGS. 1 and 2 includes a pair of longitudinal base members 16 and 18 which are arranged in spaced parallel relationship, a low-elevation standard 20, and a high-elevation standard 22. The longitudinal base members 16 and 18, and the standards 20 and 22, are desirably constructed of high quality, furniture-grade PVC pipe and fittings which are suitably joined together such as by thermal fusion, chemical adhesion, or bolts.

The longitudinal base members 16 and 18 each include a straight pipe section 24 and a pair of 90-degree elbow fittings 26 fixed to each of the ends thereof with the lateral segments of elbows 26 of each of the longitudinal base members 16 and 18 being parallel to each other.

The low-elevation standard 20 includes a pair of 90-degree elbow fittings 28 each of which is joined to a tee fitting 30 by means of a coupling 32. The tee fittings 30 are joined to one another by a transverse pipe beam 34. An upright pipe 36 is joined at one end to the remaining opening of each of the tee fittings 30. The other end of each of the pipes 36 is joined to a tee fitting 38. The tee fittings 38 are joined to one another by a second pipe beam 40. An upright pipe 42 is joined at one end to the remaining opening of each of the tee fittings 38. A coupling 44 is joined to the remaining opening of each of the 90-degree elbow fittings 26 to facilitate union of the standard 20 to each of the longitudinal base members 16 and 18.

The high-elevation standard 22 is comprised of a pair of tee fittings 46 which are joined together by a pipe beam assembly 48. Pipe beam assembly 48 preferably includes a tee fitting 50, which is located near the midpoint thereof. The lateral leg of the tee fitting 50 is angled so that its axis is approximately in alignment with the center of the platform 66. An upright pipe 54 is joined to each of the tee fittings 46 at one end. The other end of each of the upright pipes 54 is joined to a tee fitting 56. The tee fittings 56 are joined together by a pipe beam 58. An upright pipe 60 is joined to the remaining opening of each of the tee fittings 56. A coupling 62 is joined to the remaining opening of each of the tee fittings 46 to facilitate union of the standard 22 to each of the longitudinal base members 16 and 18. The lateral opening of tee fitting 50 is angled with respect to the upright pipes to receive a diagonal brace member 64 which imparts additional rigidity to the assembled apparatus 10. The various joints between the pipes and the fittings comprising the longitudinal base members 16 and 18 and the standards 20 and 22 are intended to be permanent and therefore can be riveted, fused, or otherwise permanently jointed together; whereas the various unions between the standards 20 and 22, the platform assembly 14, the brace 64 and the longitudinal base members 16 and 18 are preferably capable of repeated assembly and disassembly.

Figure 3:
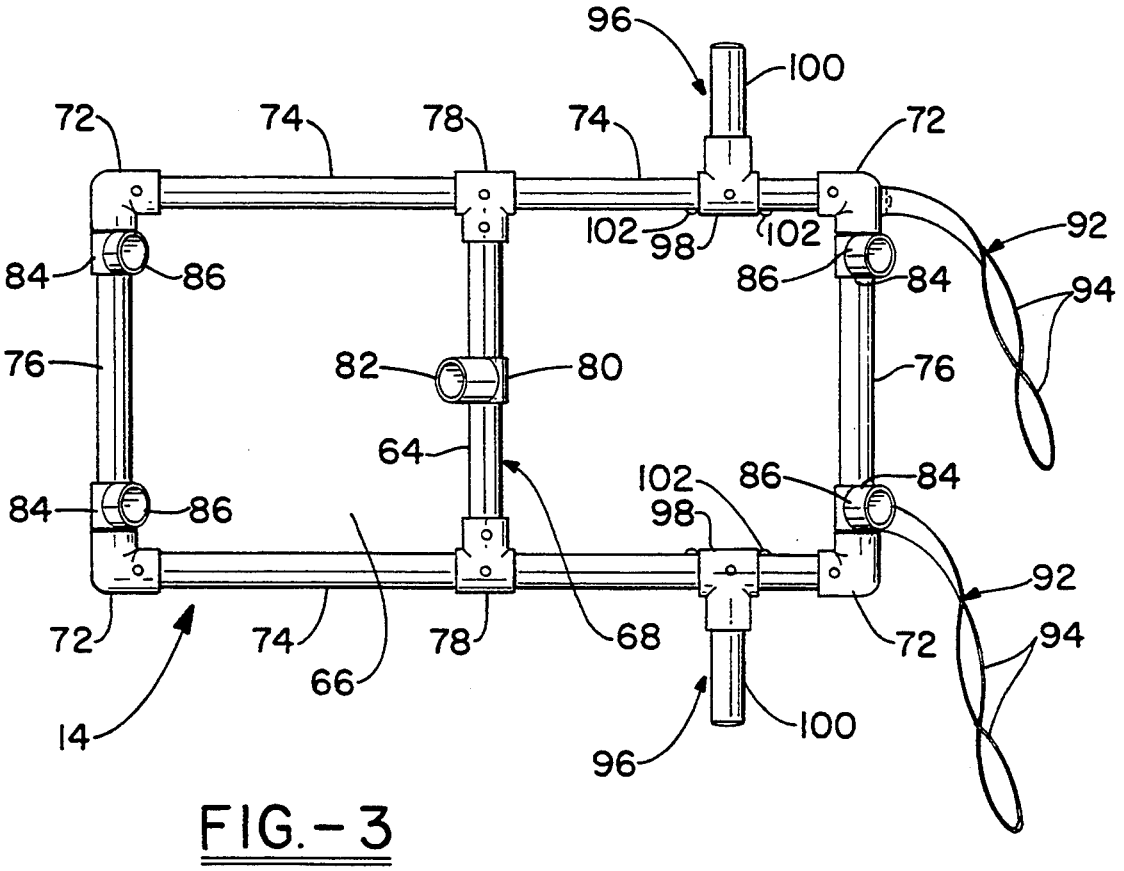
FIG. 3 is a bottom view showing the underside of the platform portion of the apparatus, shown in FIG. 1.

The platform assembly 14, the details of which are best illustrated in FIG. 3, comprises a platform 66 fixed as by means of screws, bolts, rivets, adhesives, fusion, or other conventional means to a rectangular framework. The rectangular framework has a transverse cross-member assembly 68 generally located midway between the transverse sides of the framework. The rectangular framework is generally fabricated from four 90-degree elbow fittings 72 which form the four corners of the framework. Each elbow 72 is joined together by a pair of parallel longitudinal pipe members 74. The transverse cross-member 68 is connected to the lateral legs 74 by a pair of tee fittings 78, each of which is located on one of the longitudinal pipe members 74 near the midpoint thereof. The transverse cross-member 68 has a tee fitting 80 thereon near the midpoint thereof with the lateral leg of tee fitting 80 being fixed at an angle so that it is in alignment with the lateral leg of tee 50. The lateral leg of tee 80 includes a cylindrical stub 82 into which brace 64 is tightly receivable.

Each of the transverse pipe members 76 includes a pair of tee fittings 84 at the ends thereof. The lateral legs of tee fittings 84 are each biased toward the front or lowered end of the platform 66 by an angle such as about 14 degrees with respect to a line normal to the plane of the platform assembly 14. This angle is generally equal to the inclination of the platform 66. The incline of the platform is intended to position the axis of the vaginal passage of the female partner along a horizontal direction thereby facilitating maximum penetration. The platform is desirably inclined at an angle of from about 10 to about 20 degrees, and most preferably about 14 degrees with respect to a horizontal plane. The lateral legs of the tee fittings 84 each include a cylindrical stub 86 which is receivable in a respective one of the upright pipes 42 and 60 of standards 20 and 22, respectively.

The platform 66 is preferably fabricated from a durable, lightweight plastic such as polycarbonate or PVC. In accordance with the preferred embodiment, the platform 66 is contoured to provide for lumbar support.

The frame 12 is assembled by fitting each of the couplings 44 of standard 20 to one of the laterally extending segments of a respective one of the longitudinal base members 16 and 18 such that the longitudinal directions of base members 16 and 18 are perpendicular to the upright pipes 42 and 60 of standards 20 and 22, respectively. The base members 16 and 18 are removably secured to standards 20 and 22 respectively such as by bolts and wing nuts. Brace member 64 is then inserted into and fictionally engaged by the lateral leg of tee 80. The platform assembly 14 is then fitted onto the frame by appropriately aligning stubs 86 with openings of upright pipes 42 and 60 of standards 20 and 22 and inserting the stubs 86 therein whereupon the stubs are fictionally engaged by the inner walls of upright pipes 42 and 60. Simultaneous with the insertion of stubs 86 into pipes 42 and 60, stub 82 is inserted into and is fictionally engaged by the inner walls of tubular brace member 64.

The apparatus is customized or customizable to accommodate men of various heights. For example, the apparatus can be supplied with upright legs of sufficient length to accommodate the tallest of men, but which can be cut to a custom length to accommodate shorter men. Alternatively, the apparatus can be provided with legs of adjustable height, if desired.

Figure 4:
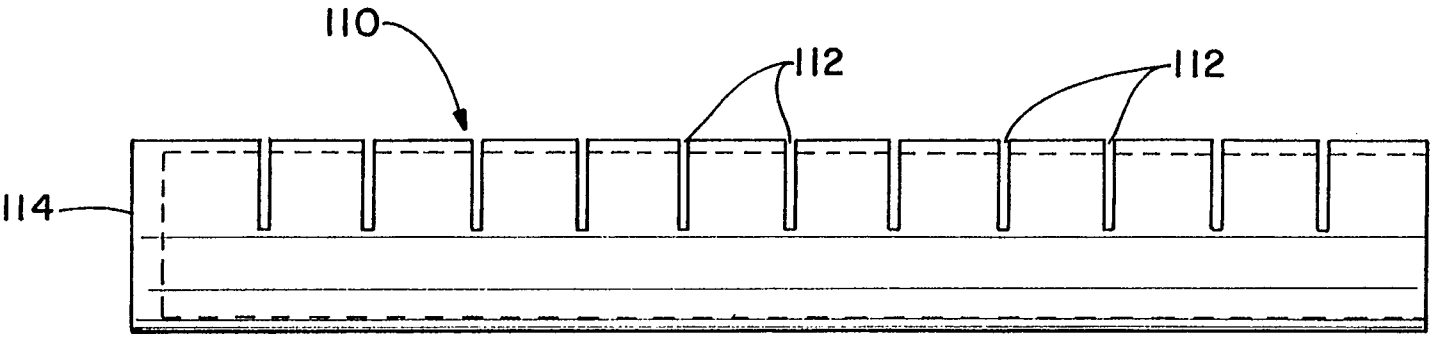
FIG. 4 is a plan view of a cutting-guide used to customize the platform height of the apparatus for a particular user.

In accordance with a preferred aspect of the invention the apparatus is provided with upright pipes 42 and 60 of sufficient length so that they can be cut to an appropriate length wherein the apparatus can accommodate the overwhelming majority of the adult male population. The apparatus is preferably provided with a special multiple slot cutting-guide 110, shown in FIG. 4. The cutting-guide 110 is used to ensure that the uprights 42 and 60 are provided with a smooth transverse cut, and that equal portions are cut from each of the uprights, so that the platform is at the appropriate angle and desired customized elevation as set forth hereinabove. The cutting-die 110 is desirably used in conjunction with a chart or table which correlates the sum of the vertical distance from the floor to the male's genitalia and the vertical distance from a horizontal base to the vaginal opening of the female while in a supine position, with the appropriate cutting slot 112 which is to be utilized for customizing the apparatus. After the appropriate measurements have been made and the corresponding slot 112 for customizing of the apparatus has been determined, the cutting-guide 110 is slid over the upper end of one of the four uprights 42 and 60 so that the end of the upright abuts a cap or stop 114 at one end of the cutting-guide. A saw is then used to cut the upright by inserting the saw blade into the appropriate slot 112 and sawing. Each of the slots can generally extent for about 180 degrees around the circumference of the tube-like cutting-guide 110. After the upright has been cut about half-way through, taking care not to saw through the cutting-guide, the cutting-guide 110 is rotated and the remainder of the upright is sawed off. This process is repeated for each of the other three uprights 42 and 60. The cutting-guide 110 is tube shaped and has an inner diameter which is slightly larger than the outer diameter of the uprights 42 and 60. A cap or stop 114 is provided at one end so that the cutting-guide 110 can only be slid over an upright from one end of the cutting-guide. The slots can for example be spaced about ½" from each other, thereby accommodating the user to within about ¼" of the ideal customized platform height.

The apparatus includes a pair of stirrups 92 which can be suitably fastened as by bolts to the corners at the lowered end of inclined platform assembly 14. The stirrups preferably include a plurality of loops 94 to facilitate repositioning of the legs as desired.

The apparatus 10 preferably includes a pair of laterally positioned handle assemblies 96 which allow the female to reposition her body as desired. Desirably, the handle assemblies 96 can be rotated or folded away to provide a more compact structure for storage and transportation. In accordance with the preferred embodiment, each of the handle assemblies 96 comprises a tee fitting 98 mounted on each of the respective pipe members 74 with a grip portion 100 joined to the lateral leg of each of the tee fittings 98. A pair of stops 102, one on each side of the tee fitting 98, are fastened to the platform assembly 14 to prevent lateral movement of the handle assemblies 96 along pipe members 74. The handles 16 and stirrups 92 can be used in concert to allow the female excellent freedom of movement during use of the apparatus.

The apparatus is also ideally suited for facilitating sexual intimacy with a pregnant woman. In particular, the apparatus, by facilitating sexual intercourse between a reclined female and a standing male, allows a pregnant woman to engage in sexual intimacy without placing undue pressure on the woman's abdomen.

In accordance with another aspect of the invention, the apparatus can be converted to an exercise device, which can be used by one, or by two people simultaneously. For example, stretchable resistance devices can be attached to the handles 96 or other parts of the frame 12 or platform assembly 14 to allow for resistance training to strengthen leg, arm or other muscles.

While in accordance with the patent statutes the best mode and preferred embodiment has been set forth, the scope of the invention is not limited thereto, but rather by the scope of the attached claims.

What is claimed is:

1. An apparatus for facilitating sexual intercourse between a female partner in a supine position and a male partner in a standing position, comprising a frame and a platform mounted on said frame at an angle and at an elevation which places the vaginal passage of the female in alignment with the distended genitalia of a male partner standing adjacent to the lower end of the platform, said apparatus further comprising means for supporting the lower limbs of the female partner while the female partner is supported in a supine position on the platform with her vagina overlapping the lower end of the platform.

2. The apparatus of claim 1, wherein the platform is inclined at an angle which places the vaginal passage of a female partner approximately in alignment with the distended genitalia of a male partner standing adjacent to the lower end of the platform.

3. The apparatus of claim 1, wherein the platform is inclined at an angle of from about 10 to about 20 degrees with respect to a horizontal plane.

4. The apparatus of claim 1, wherein the platform is inclined at an angle of about 14 degrees with respect to a horizontal plane.

5. The apparatus of claim 1, wherein the lower limb support means is a pair of stirrups.

6. The apparatus of claim 1, further comprising a pair of handles which allow the female to reposition her body as desired.

7. An apparatus for facilitatinq sexual intercourse between a female partner in a supine position and a male partner in a standing position, comprising a frame and an inclined platform mounted on said frame, further comprising means for supporting the lower limbs of the female partner, wherein the lower limb support means is a pair of stirrups, and wherein the stirrups each include a plurality of loops to facilitate repositioning of the lower limbs of the female as desired.

8. An apparatus for facilitating sexual intercourse between a female partner in a supine position and a male partner in a standing position comprising a frame and an inclined platform mounted on said frame, wherein the platform is inclined at an angle which places the vaginal passage of a female partner approximately in alignment with the distended genitalia of a male partner standing adjacent to the lower end of the platform, and wherein the elevation of the platform has been customized to accommodate a particular male partner.

9. The apparatus of claim 8, wherein the elevation has been customized by utilizing a tube-like cutting-guide having a plurality of slots each of which corresponds approximately to a desired platform elevation, said cutting-guide being slidable over certain vertical frame members to present a guide for sawing said vertical frame members to an appropriate length.

10. An apparatus for facilitating sexual intercourse between a female partner in a generally supine position and a male partner in a standing position, comprising a frame and a platform mounted on said frame at an angle and at an elevation which places the vaginal passage of the female in alignment with the distended genitalia of a male partner standing adjacent to the lower end of the platform, said apparatus including a pair of stirrups for supporting the lower limbs of the female and a pair of laterally positioned handles which can be used by the female in concert with said stirrups to facilitate repositioning of the body-as desired during use of the apparatus.

11. The apparatus of claim 10, wherein the platform is inclined at an angle of from about 10 to about 20 degrees with respect to a horizontal plane.

12. The apparatus of claim 10, wherein the platform is inclined at an angle of about 14 degrees with respect to a horizontal plane.

13. The apparatus of claim 11, wherein the stirrups each include a plurality of loops to facilitate repositioning of the lower limbs of the female as desired.

* * * * *